US008102107B2

(12) United States Patent
Hsieh

(10) Patent No.: US 8,102,107 B2
(45) Date of Patent: Jan. 24, 2012

(54) LIGHT-EMITTING DEVICES HAVING EXCITED SULFUR MEDIUM BY INDUCTIVELY-COUPLED ELECTRONS

(75) Inventor: Hung-Yuan Hsieh, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 317 days.

(21) Appl. No.: 12/611,882

(22) Filed: Nov. 3, 2009

(65) Prior Publication Data

US 2010/0123408 A1 May 20, 2010

(30) Foreign Application Priority Data

Nov. 18, 2008 (TW) ..... 97144472 A

(51) Int. Cl.
*H01J 1/50* (2006.01)

(52) U.S. Cl. ..... 313/161; 313/637; 315/248

(58) Field of Classification Search ..... 313/153, 313/160, 161, 317, 567, 637; 315/248
See application file for complete search history.

(56) References Cited

U.S. PATENT DOCUMENTS 4,071,798 A * 1/1978 Hammond ..... 313/18
5,072,157 A * 12/1991 Greb et al. ..... 315/248
5,404,076 A 4/1995 Dolan et al.
5,594,303 A 1/1997 Simpson et al.
5,757,130 A 5/1998 Dolan et al.
5,841,244 A * 11/1998 Hamilton et al. ..... 315/248
5,847,517 A 12/1998 Ury et al.
5,903,091 A * 5/1999 MacLennan et al. ..... 313/161
5,914,564 A 6/1999 Gabor et al.
5,990,624 A 11/1999 Maya
6,313,587 B1 11/2001 MacLennan et al.
6,476,557 B1 11/2002 Leng et al.
6,518,703 B1 2/2003 Hochi et al.
6,617,806 B2 9/2003 Kirkpatrick et al.
2007/0075617 A1 4/2007 Park
2007/0075651 A1 4/2007 Park

* cited by examiner

*Primary Examiner* — Thuy Vinh Tran

(57) ABSTRACT

A light-emitting device having an excited sulfur medium by inductively-coupled electrons is provided. This device includes a substrate, an energy transmission coil disposed over the substrate, a transparent discharge cavity disposed over the energy transmission coil, having a substantially planar top and bottom surface, and a high-frequency oscillating power supply coupled to the energy transmission coil. While power up, the energy transmission coil induces an electromagnetic field within the transparent discharge cavity of the light-emitting device. In one embodiment, the transparent discharge cavity includes a sulfur-containing medium disposed within the transparent discharge cavity, and a buffer gas or a plurality of buffer gasses filling inner space of the transparent discharge cavity.

23 Claims, 10 Drawing Sheets

LIGHT-EMITTING DEVICES HAVING EXCITED SULFUR MEDIUM BY INDUCTIVELY-COUPLED ELECTRONS

CROSS REFERENCE TO RELATED APPLICATIONS

This application claims priority of Taiwan Patent Application No. 97144472, filed on Nov. 18, 2008, the entirety of which is incorporated by reference herein.

BACKGROUND OF THE INVENTION

1. Field of the Invention

The invention relates to light-emitting devices, and in particular, to light-emitting devices, wherein inductively coupled electrons excite a sulfur medium therein, and a transparent discharge chamber therein is formed with no built-in electrode inside of the chamber.

2. Description of the Related Art

There are various types of lighting sources, e.g., an incandescent lamp using radiation associated with a burning filament, a fluorescent lamp composed of an electric discharge tube and a fluorescent-powder coating for energy conversion, a high-intensity-discharge (HID) lamp that induces electrical discharge within a highly-pressurized gas or steam, and an electrodeless plasma lighting system (PLS) lamp that generates lighting plasma of gaseous media with no media-contacting electrodes.

The various types of lamps have their respective advantages. For example, incandescent lamps are excellent in color rendition and small in size. Switching circuits of the incandescent lamps are simple and low cost. However, compared to other lamps, incandescent lamps are less power efficient and have a shorter life span. In the other end, fluorescent lamps are more power efficient in emitting light and more durable than other lamps. However, while compared with incandescent lamps, fluorescent lamps are relatively large in size. Additionally, fluorescent lamps require also additional power-ballasting circuits to stabilize discharge current and light output thereof. Other gas-discharge lamps like HID lamps are also power efficient and durable. The HID lamps require, however, a relatively long time for restriking on upon switching off. In addition, HID lamps, similar to fluorescent lamps, requires additional power-ballasting circuits to assist switching. Electodeless PLS lamps possess longest life among all the above-noted lamps. The electrodeless PLS lamps though are acceptably efficient in emitting light but relatively much expensive. The electrodeless PLS lamps require also additional power-ballasting (though similar but more complex) circuits for switching.

One type of electrodeless PLS lamps, called electrodeless sulfur lamp, is particularly efficient in emitting white light of broadband spectrum even closely resembling to natural sun light.

U.S. Pat. Nos. 5,404,076, 5,594,303, 5,847,517 and 5,757,130, issued to Fusion System Corporation, discloses electrodeless sulfur lamps.

The electrodeless sulfur lamps disclosed in the above noted US patents consist of a of golf-ball sized quartz bulb containing ten to hundred milligrams of sulfur powers and argon gas at an end of a spindle for rotation. The bulb absorbs microwave energy of 2.45 GHz generated from a magnetron to excite buffering gas of low pressure argon therein and generates gaseous discharging plasma. As a consequence, the space within the quartz bulb is thus supplied with an appropriate amount of free electrons. The sulfur powers absorb the microwave energy to heat and vaporize itself, thereby raising the pressure inside the quartz bulb to 5~10 times that of the surrounding atmosphere. The gaseous sulfur vapors elevate to a temperature in the quartz bulb under the continuous reaction with microwaves and plasmas of inert buffering gas and are thus stimulated to ionize and discharge. The sulfur ions vigorously oscillate within the space of a narrow mean free path and collapse within itself, thereby causing a molecular-type charge/discharge process. Such a process is further aggravated by excitation and collision with highly energetic gas ions in the buffering gas plasma, thereby forming additional luminous thermal plasma of new media and emitting great amounts of photons, having a spectrum of about 73% of visible light, resembling to that of sunlight.

Nevertheless, the electrodeless sulfur lamps disclosed in the above noted US patents need a power source of more than 1.5 KW to reach a luminous efficiency of about 100 lumens per watt. As a result its application is confined to illuminate only large public spaces. In addition, the electrodeless sulfur lamps disclosed by the above noted US patents are normally large in size and appropriate means of electromagnetic shielding in most cases are mandatory, particularly for indoor applications. Therefore, the electrodeless sulfur lamps disclosed by the above noted US patents are not suitable for low power or planar luminance applications.

BRIEF SUMMARY OF THE INVENTION

Thus, a light-emitting device having an excited sulfur medium by inductively-coupled electrons is provided for low power or planar luminance applications.

An exemplary light-emitting device having an excited sulfur medium by inductively-coupled electrons comprises a substrate, an energy transmission coil disposed over the substrate, a transparent discharge cavity disposed over the energy transmission coil, having a substantially planar top and bottom surface, and a high-frequency oscillating power supply coupled to the energy transmission coil. While powering up, the energy transmission coil induces an electromagnetic field within the transparent discharge cavity of the light-emitting device. In one embodiment, the transparent discharge cavity comprises a sulfur-containing medium disposed within the transparent discharge cavity, and a buffer gas or a plurality of buffer gasses filling inner space of the transparent discharge cavity.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is one of the best-contemplated mode of carrying out the invention. This description is made for the purpose of illustrating the general principles of the invention and should not be taken in a limiting sense. The scope of the invention is best determined by reference to the appended claims.

Figure 1:
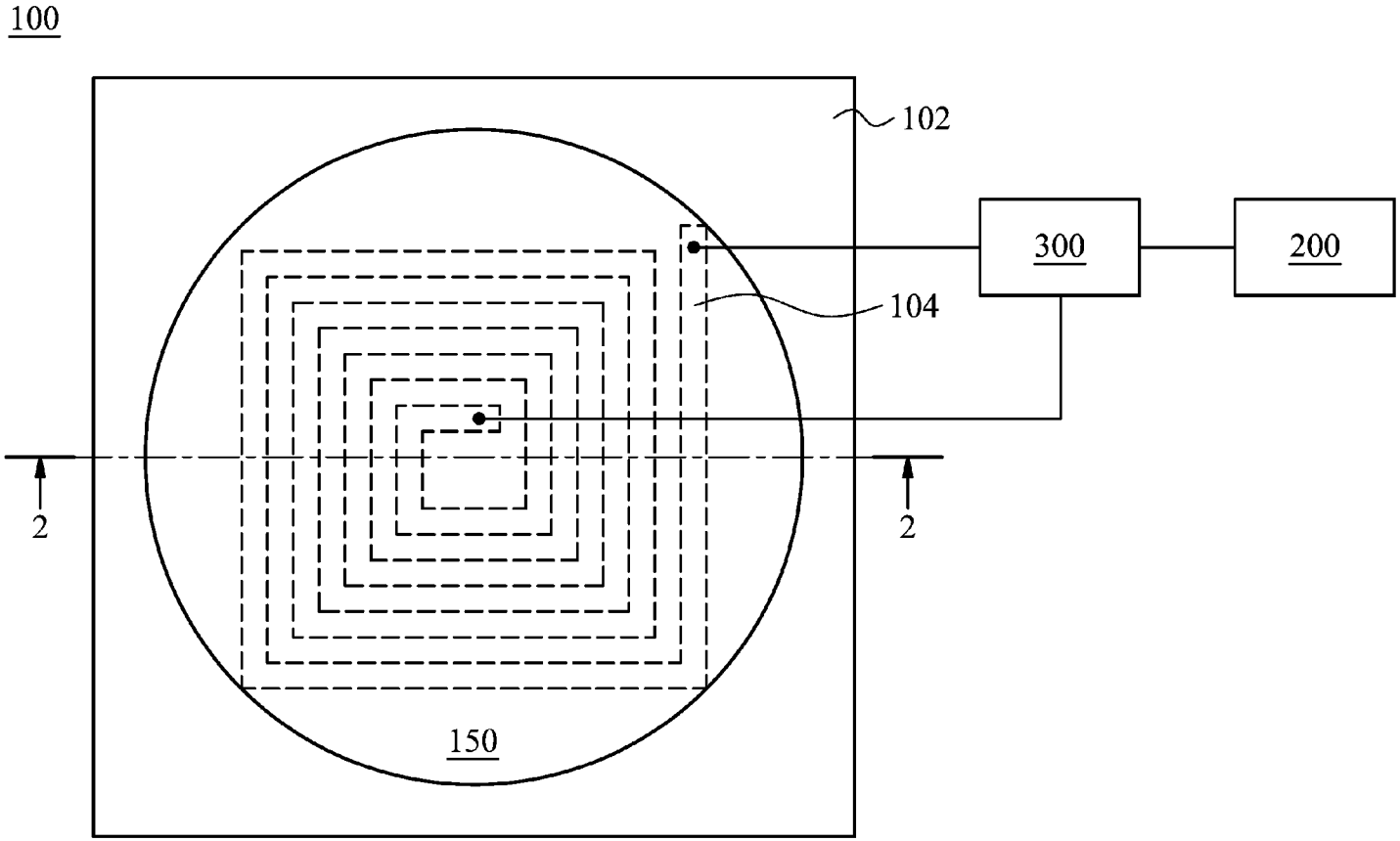
FIG. 1 is a schematic diagram showing a top view of a light-emitting device according to an embodiment of the invention.

FIG. 1 is a schematic diagram showing a top view of an exemplary light-emitting device 100. As shown in FIG. 1, the light-emitting device 100 mainly comprises a substrate 102, an energy transmission coil 104 disposed over the substrate 102, a transparent discharge cavity 150, and a high-frequency oscillating power supply 200. An impedance matching circuit 300 may be optionally provided between the energy transmission coil 104 and the high-frequency oscillating power supply 200 to improve energy transmission efficiency. As shown in FIG. 1, the transparent discharge cavity 150 has a substantially circular shape when viewed from a top view, but configuration of the transparent discharge cavity 150 is not limited thereto. The transparent discharge cavity 150 may have other orthogonal shapes when viewed from a top view.

Figure 2:
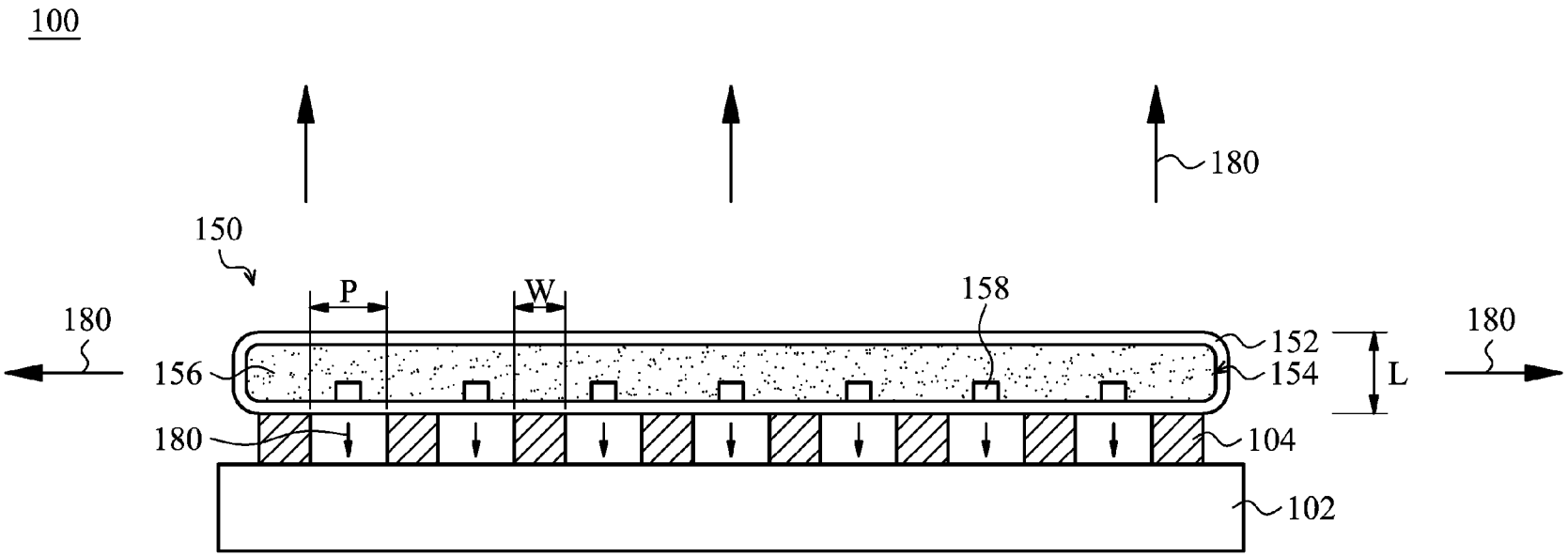
FIG. 2 shows a cross section taken along line 2-2 in FIG. 1.

FIG. 2 partially shows a cross section taken along line 2-2 of the light-emitting device 100 in FIG. 1. As shown in FIG. 2, the transparent discharge cavity 150 is a sealed hollow chamber having a substantially planar top and bottom surface. During operation, the transparent discharge cavity 150 may have an inner pressure of about 1-10 atm, and preferably of about 2-8 atm. The transparent discharge cavity 150 can be made of materials such as quartz, borosilicate, or translucent alumina which allow visible light transmission. The transparent discharge cavity 150 has an inner chamber 154 defined by a chamber wall 152 of a thickness of about 1-10 mm. The substrate 102 could be a thermally resistant substrate formed of electrical-insulating materials such as aluminum oxide or FR4 (fiber reinforced) bakelite.

The inner chamber 154 is filled with a buffer gas, for example, inert gases such as He, Ne, Ar, Kr, or combinations thereof, and preferably filled with a combination of at least two kinds of inert gases, such as a combination including Ar and Ne. A bottom surface of the inner chamber 154 may be provided with a plurality of solid sulfur mediums 158. The sulfur mediums 158 are illustrated as being separately disposed solid ingots formed by compressing pure sulfur powders. The sulfur mediums 158, however, are not limited by that illustrated in FIG. 2 and may be formed as gaseous compounds comprising sulfur-containing elements such as $H_2S$, $SF_4$, $SF_6$, and $SO_2$, etc. Unlike that illustrated in FIG. 2, the sulfur mediums 158 of gaseous compounds may be directly filled into the inner chamber 154 of the transparent discharge cavity by blending with the buffer gas 156 beforehand.

Still referring to FIG. 2, the high-frequency oscillating power supply 200 (See FIG. 1) is coupled to two ends of the energy transmission coil 104. The high-frequency oscillating power supply 200 can be, for example, an acoustic frequency oscillator, a radio frequency (RF) oscillator, or a microwave frequency oscillator. The energy transmission coil 104 may be also coupled to an impedance matching circuit 300 (See FIG. 1) which matches impedance between the high frequency oscillating power supply 200 and loading inferred from the energy transmission coil 104. If so, the energy transmission coil 104 could be supplied with pulses either DC or AC pulses having a frequency of about 1 KHz~2.45 GHz, or more preferably 5 KHz~20 MHz by the high-frequency oscillating power supply 200. Such a powering up generates an inductively coupled electric field within the transparent discharge cavity 150, and thereby excites the sulfur mediums in the transparent discharge cavity 150 to charging/discharging process cycles which result in the emitting of light 180.

Herein, during a stable operation, the light 180 emitted from the light-emitting device 100 has a broadband wavelength spectrum ranging of about 400-700 nm. The high-frequency oscillating power supply 200 which couples with the energy transmission coil 104 is operated at a power of 5-300 watts.

An embodiment of reaction mechanism of the light-emitting device 100 as shown in FIGS. 1 and 2 is described as follows. At beginning, the energy transmission coil 104 provides an inductively coupled electrical field to accelerate free electrons in the transparent discharge cavity 150. Such an action excites atoms of the buffer gas 156 which are under a lower pressure, and consequently forms a plasma of the buffer gas 156 and raises free electron density therein. An associated electrostatic coupling effects therein heat and vaporize the sulfur mediums 158 in the transparent discharge cavity 150 into sulfur-containing vapors. The sulfur-containing vapors increase pressure in the transparent discharge cavity 150 and subsequently induce another gaseous charging/discharging reaction due by frequent and vigorous collision therein. When the density of the free electrons density reaches a critical level, the electrostatic coupling effects start transforming into an electromagnetic coupling mode. Such a transition ceases using the input energy for heating up (electrostatic) the gas but instead generates an induced energy field (electromagnetic) as a vertex to accelerate and excite the sulfur atoms in the sulfur-containing vapors. As a result, it causes substantial charging/discharging process cycles of sulfur atoms and releasing even greater amounts of electrons into the plasma atmosphere.

When the sulfur-containing vapors in the transparent discharge cavity 150 reach a saturated pressure, the ionized buffer gases 156 dramatically collapse with the sulfur atoms/ions of the sulfur-containing vapors. These atoms and ions vigorously collide with each other in an increasing frequency due to an increasingly crowded particle density of narrow mean free path in between and severely thermal vibration of the particles. Such a three-body collision of atoms, ions, and electrons eventually forms charged diatomic sulfur radicals in an metastable and/or excited state. These ionization and recombination process cycles continuously increases in intensity and releases great amounts of photons which emit light 180. High luminous efficacy is achieved as greater than 73% of light 180 is located within the visible range.

Herein, a top surface of the energy transmission coil 104 in the light-emitting device 100 illustrated in FIGS. 1 and 2 is apart from a top surface 150 of the transparent discharge cavity 150 with a distance L of about 3-50 mm. The transparent discharge cavity 150 is formed with a greater planar size than that of the energy transmission coil 104 disposed over the insulative substrate 120 to purposely ensure energy transmission and utilization efficiency. So that the inductively coupled energy field over the top of the energy transmission coil 104 can be fully surrounded by the transparent discharge cavity 150. Such an arrangement avoids blind-corner effects and may thus enhance efficiency of energy input for both to heat and to vaporize sulfur-containing mediums 158 within the transparent discharge cavity 150 and consequently luminous efficacy of the light-emitting device 100.

Figure 3:
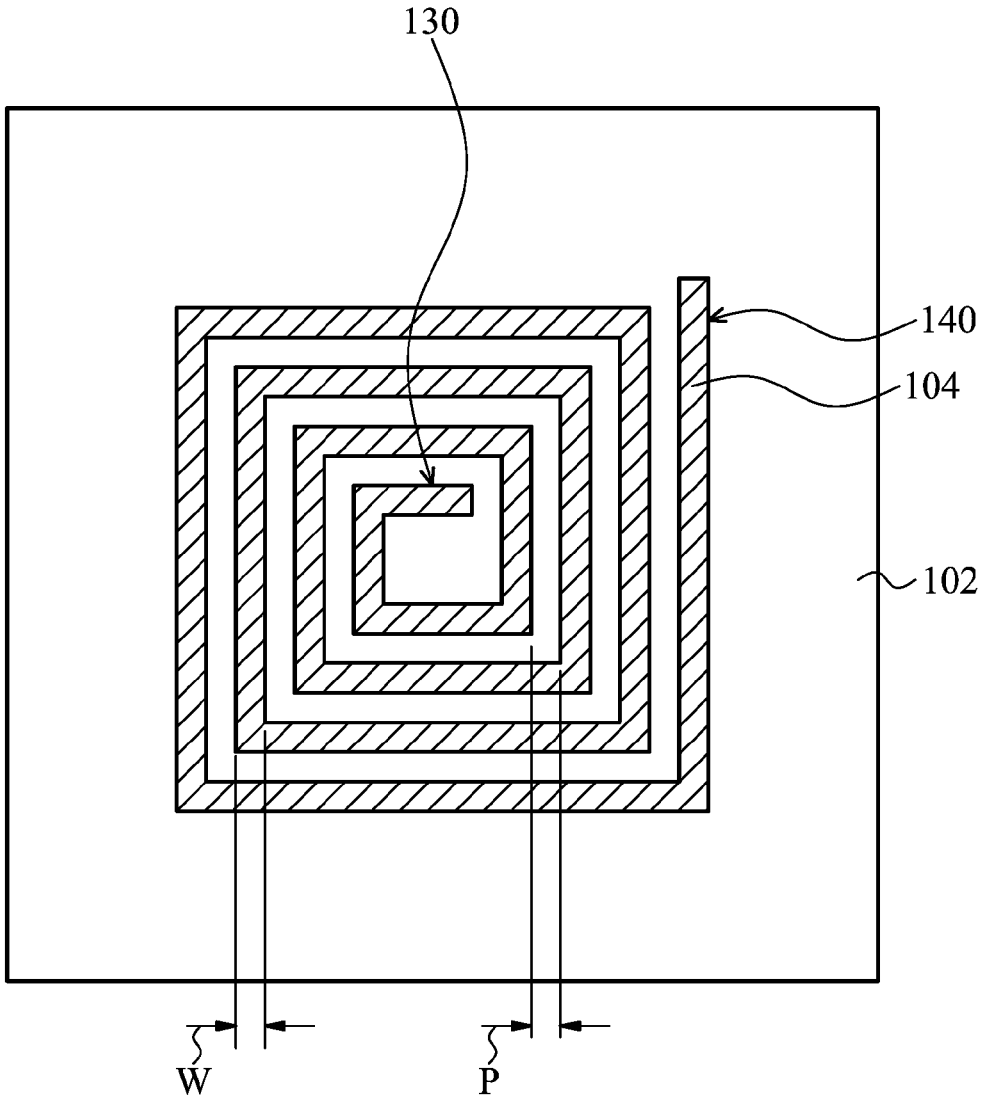
FIG. 3 is a schematic diagram showing a top view of an energy transmission coil according to an embodiment of the invention.
Figure 4:
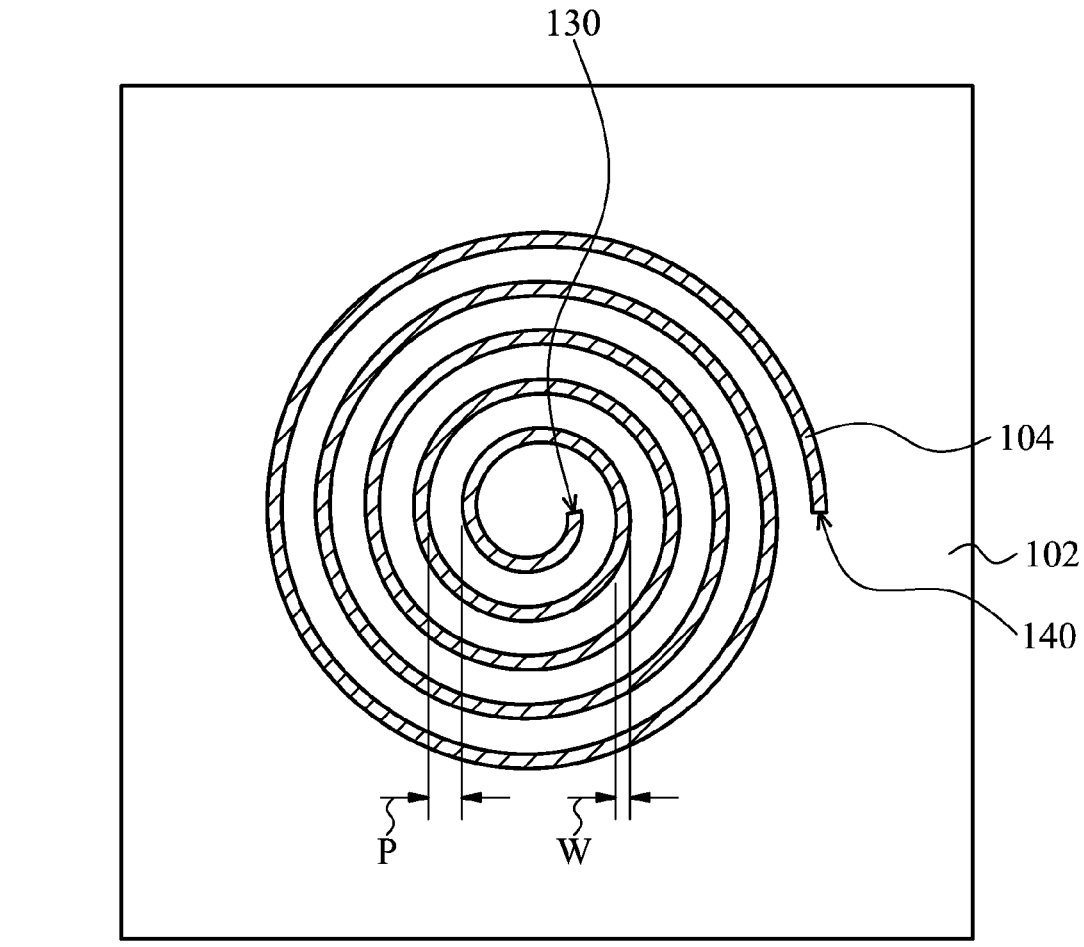
FIG. 4 is a schematic diagram showing a cross section of an energy transmission coil according to another embodiment of the invention.
Figure 5:
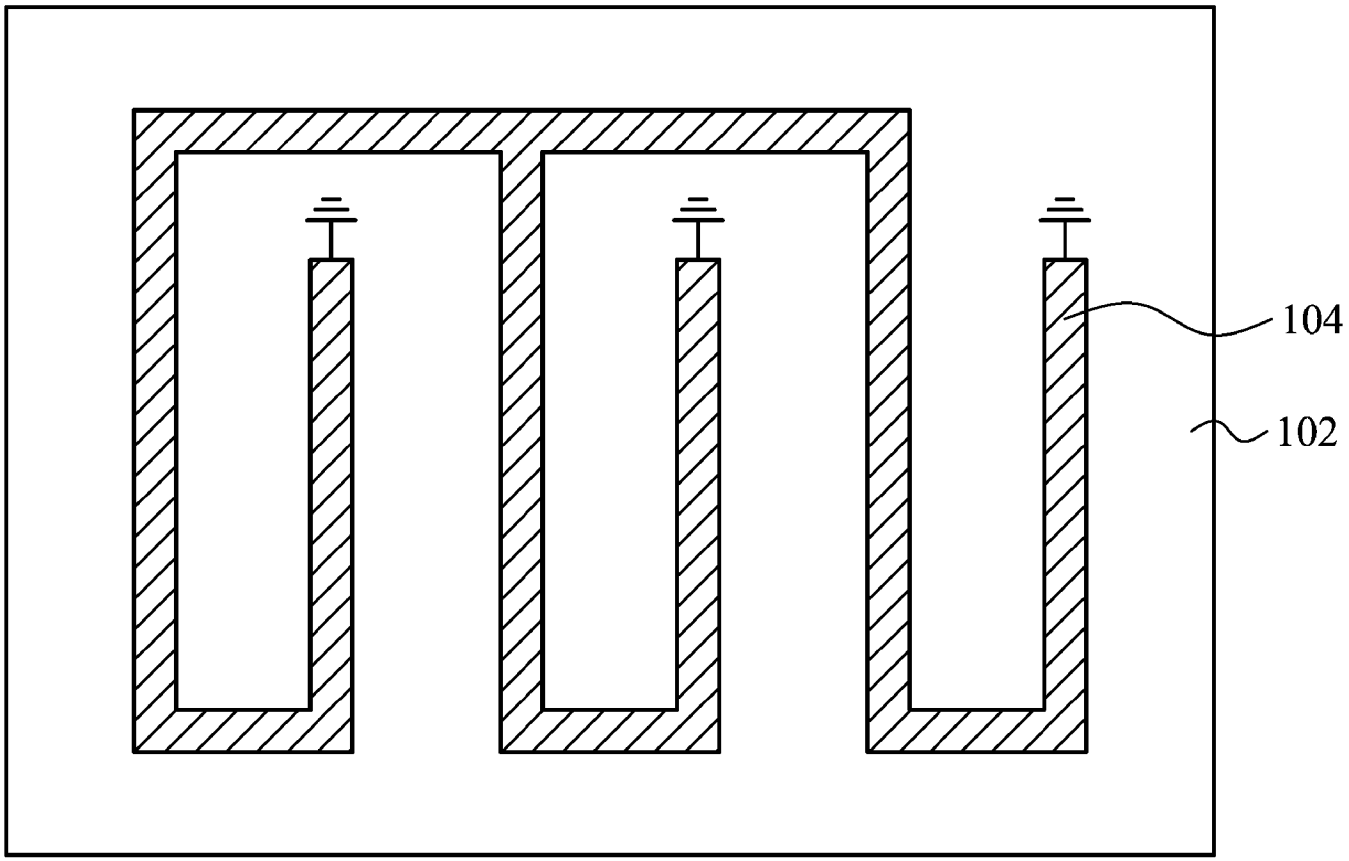
FIGS. 5-8 are schematic diagrams showing top views of an energy transmission coil according to various embodiments of the invention, respectively.
Figure 6:
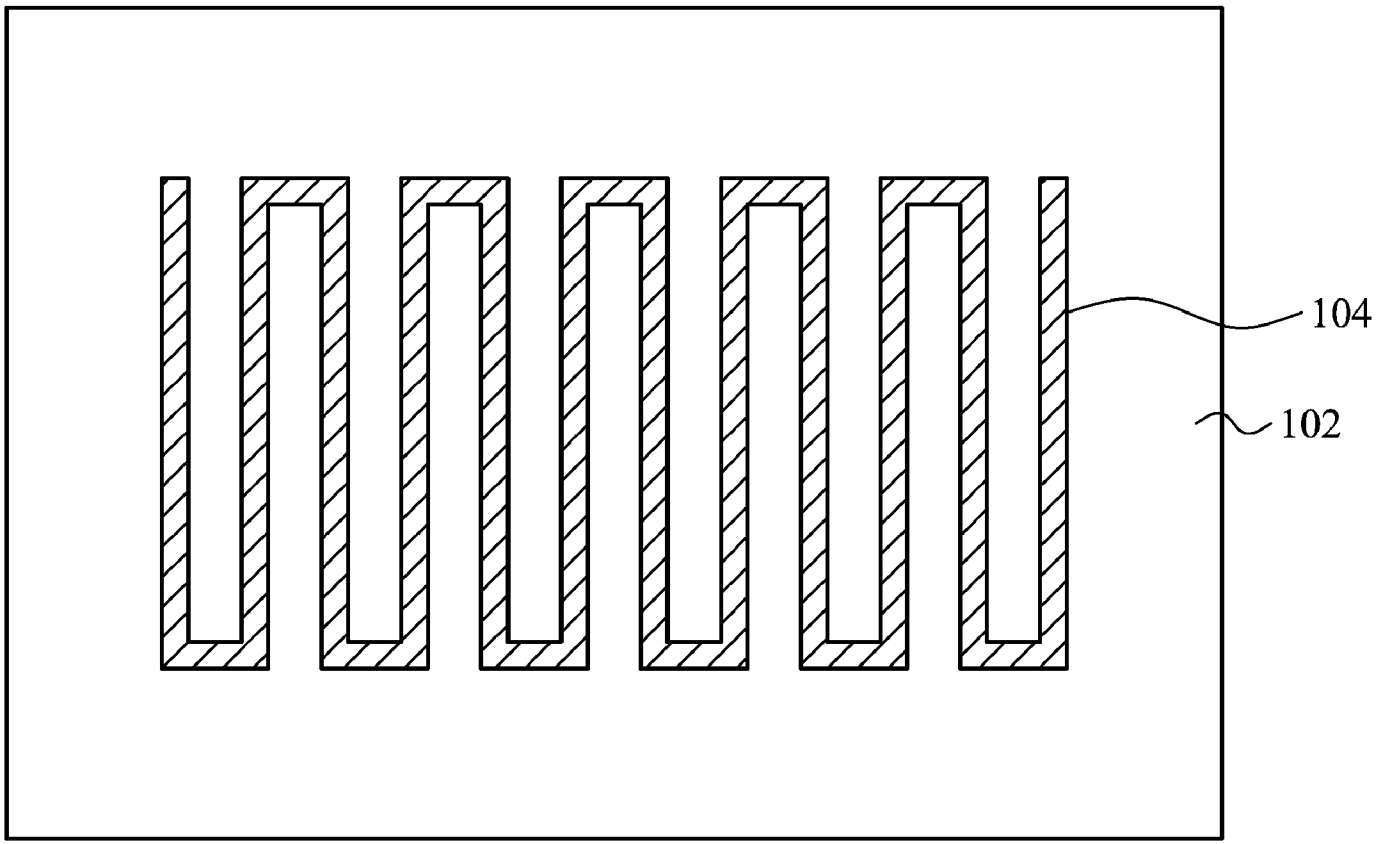
Figure 7:
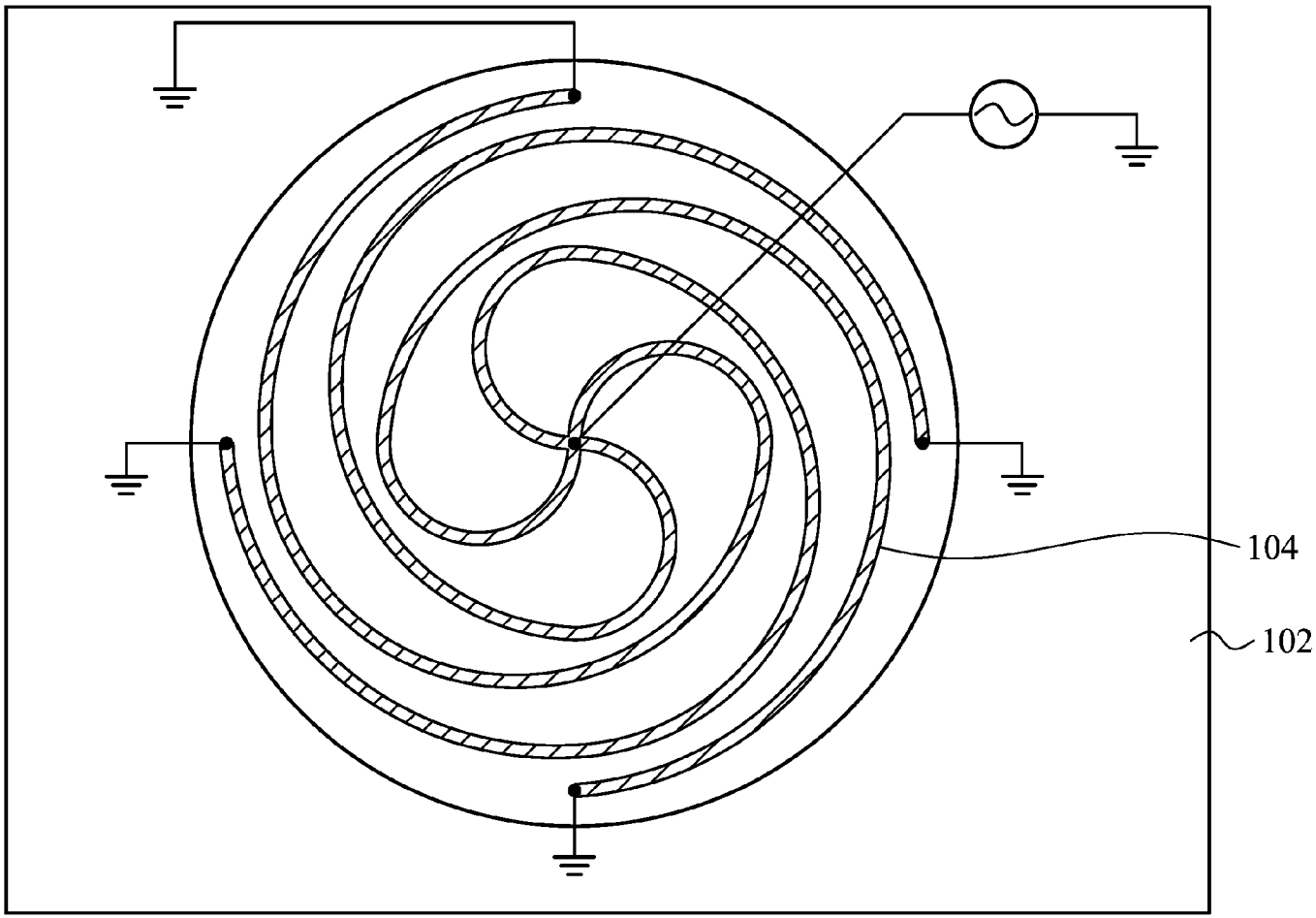
Figure 8:
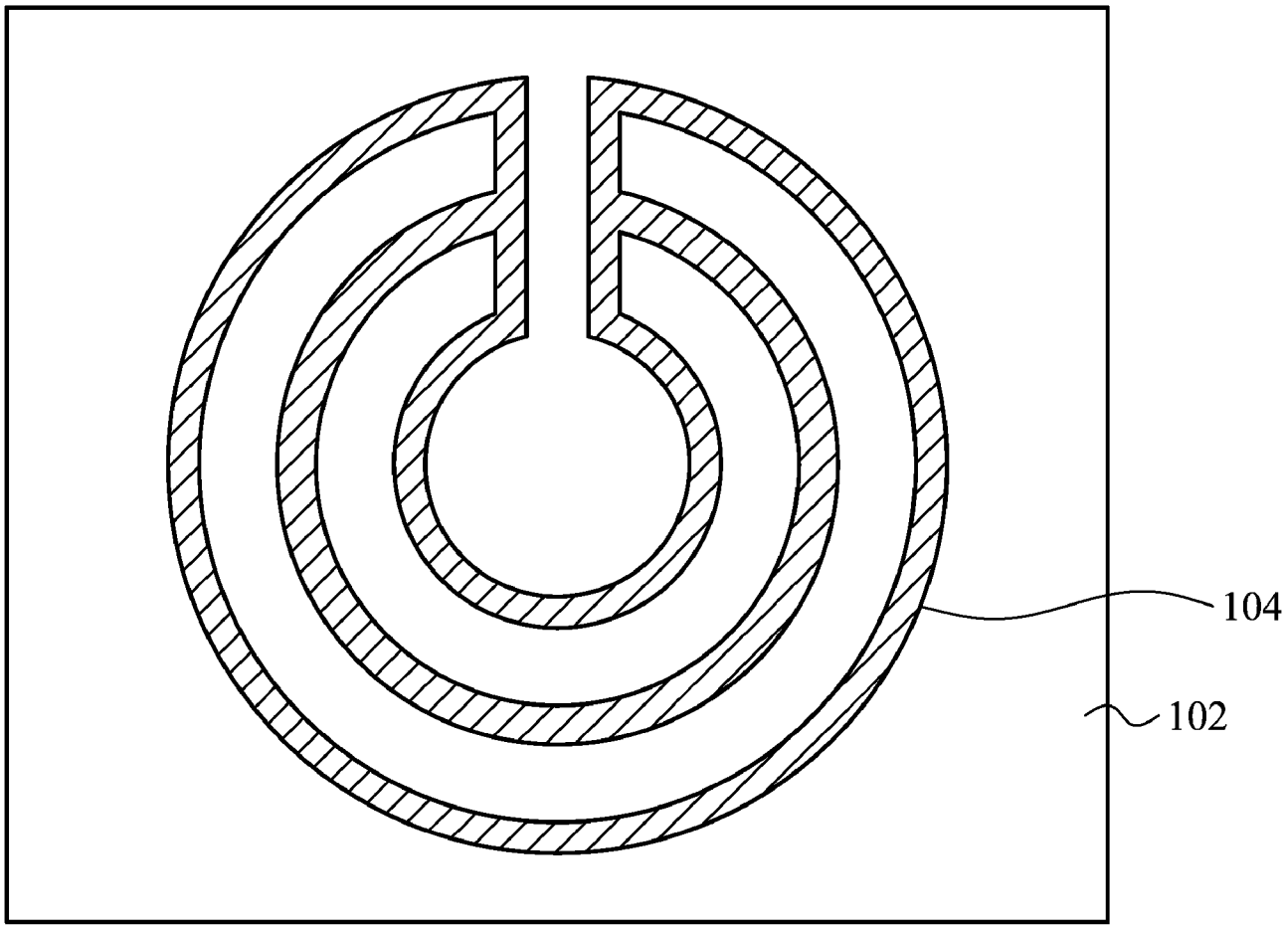

FIGS. 3 and 4 are schematic diagrams respectively showing two configurations of the energy transmission coil 104 viewed from a top view. The energy transmission coil 104 can be formed as a loop having a substantially rectangular helix shape or a substantially circular helix shape when viewed from a top view. However, as shown in FIGS. 5-8 all from a top view, the energy transmission coil 104 of the light-emitting device 100 can be configured as other shapes that induce inductively coupling effects such as a U-shaped line (See FIG. 5), a meander (serpentine) line (See FIG. 6), a S-shaped line (See FIG. 7) or multiplexed parallel lines (See FIG. 8). The energy transmission coil 104 can be made of conductive metals such as copper; or sintered thick films of pastes containing conductive particles such as silver, palladium or transparent conductive oxides like ITO. Each segment in the energy transmission coil 104 is formed with a pitch P of about 0.1-0.5 mm therebetween and a line width W of about 0.1-10 mm. Both ends 130, 140 of the energy transmission coil 104 are connected to the high-frequency oscillating power supply. Herein, the energy transmission coil 104 is illustrated as a conductive element disposed over the substrate 102 and above a top surface thereof. But it is not limited to only such a configuration. For examples, the energy transmission coil 104 can also be embedded within the substrate 102, being directly attached on an outer surface of the chamber wall 152 of the transparent discharge cavity 150, or be directly embedded within the chamber wall 152 of the transparent discharge cavity 150. Such embedding alternatives may improve flatness of configurating elements and ease to integrate the light-emitting device 100 for particular applications such as in flat panel displays or projectors.

Figure 9:
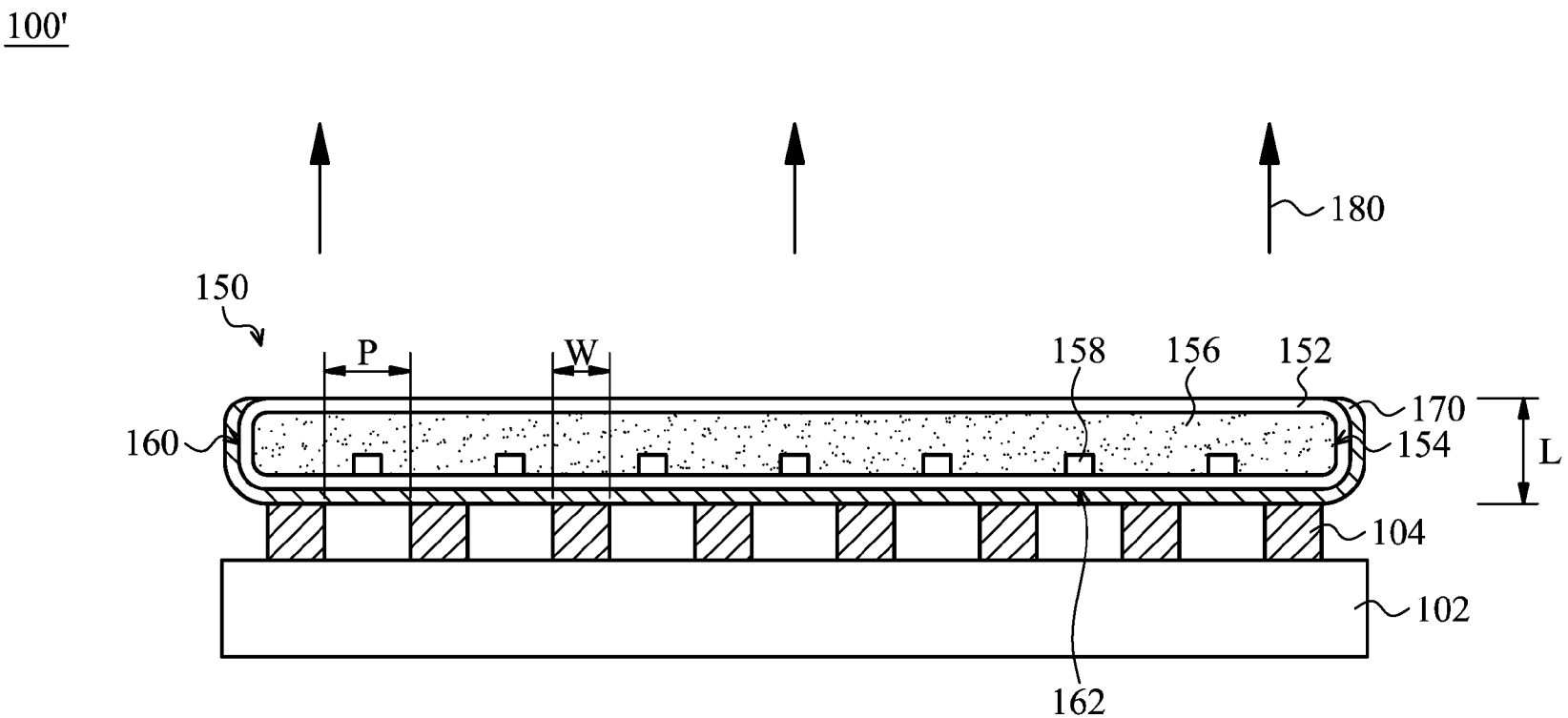
FIG. 9 is a schematic diagram showing a top view of a light-emitting device according to another embodiment of the invention.

FIG. 9 is a schematic diagram showing another exemplary light-emitting device 100'.

As shown in FIG. 9, similar to the light-emitting device 100 shown in FIG. 2, the light-emitting device 100' is coated with a light reflection layer 170 at side wall 160 and bottom surface 162 to modulate illuminating direction and to improve luminous efficacy. The light reflection layer 170 can be made of simple metal oxides such as titanium dioxide ($TiO_2$) or of a multi-layered dichroic coating, which utilizes light interference, such as $TiO_2$—$SiO_2$ to modulate light propagation. The light reflection layer 170 can also be made of thin metal films such as Ag, Au or Al. But for such cases, the metal films must be covered with other dielectric barriers such as glass, barium titanate, silicon oxide or titanium oxide for a proper electrical insulation from contacting the power transmission coil underneath. For all cases, the material of the light reflection layer 170 must be transmissive to the electromagnetic wave (e.g. a frequency between 5 KHz-20 MHz) for power transmission from the high-frequency oscillating power supply 200 and must be electrically insulative.

Figure 10:
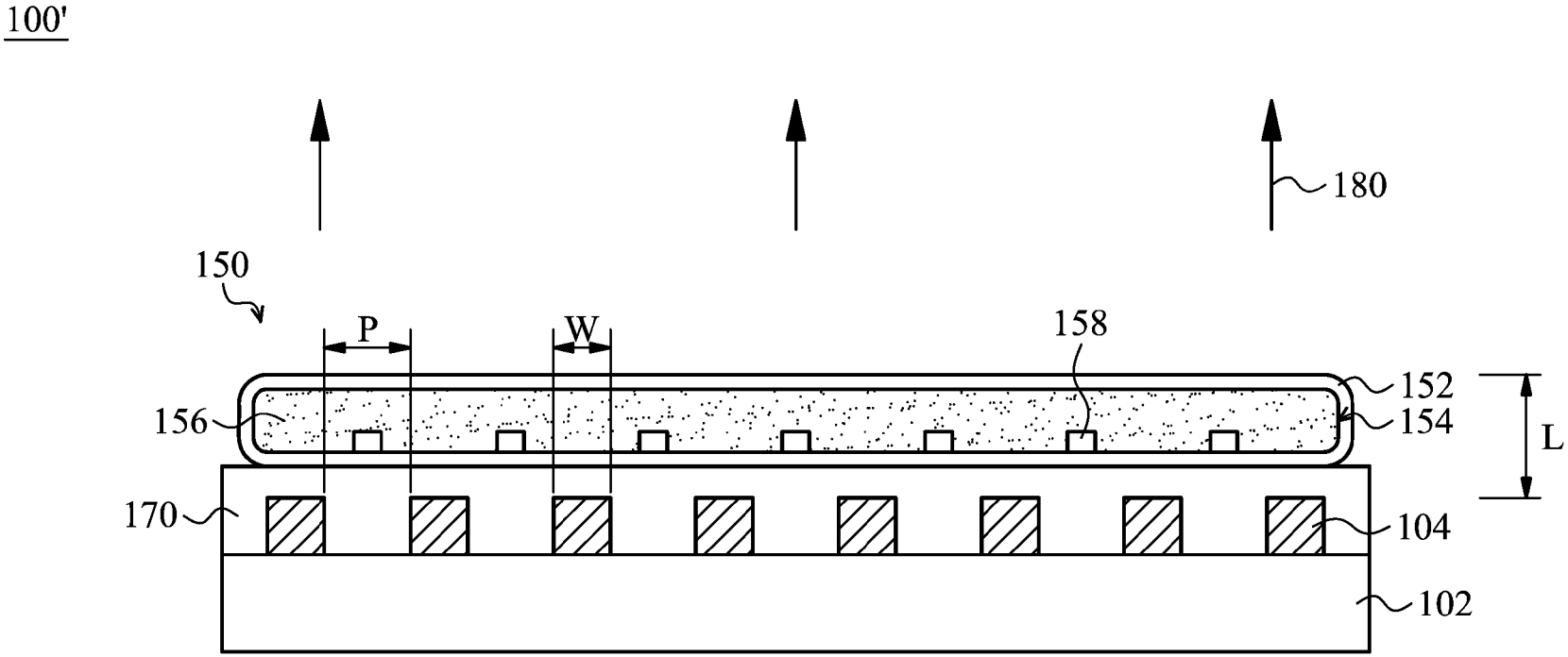
FIG. 10 is a schematic diagram showing a top view of a light-emitting device according to another embodiment of the invention.

The light reflection layer 170 is not limited to the location illustrated in FIG. 9. As shown in FIG. 10, the light reflection layer 170 can be directly formed over the substrate 102 and fully cover the energy transmission coil 104. In this case, the transparent discharge cavity 150 can thereby be directly disposed over the light reflection layer 170. Or alternatively, the light reflection layer 170 can be integrated into the outer surface of the chamber wall 152 of the transparent discharge cavity 150. And as configured in FIG. 10 embedding therein the energy transmission coil 104 thereby omitting the necessity of the substrate 102. As noted previously, the material of the light reflection layer 170 must be transmissive to the electromagnetic wave for power excitation from the high-frequency oscillating power supply and must be electrically insulative.

Within the transparent discharge cavity 150 of the light emitting device 100/100', free radicals or metastable ions of the ionized buffer gases 156 dramatically collapse with the sulfur atoms/ions of the sulfur-containing vapors to form charged diatomic sulfur radicals. These atoms and ions vigorously collide with each other in an increasing frequency due to an increasingly crowded particle density of narrow mean free path in between and severely thermal vibration of the particles. Such a three-body collision of atoms, ions, and electrons eventually forms charged diatomic sulfur radicals in an metastable and/or excited state. These ionization and recombination process cycles continuously increases in intensity and releases great amounts of photons which emit light 180. High luminous efficacy is achieved as greater than 73% of light 180 is located within the visible range.

The light-emitting device 100/100' has a luminous efficiency greater than 60 lumens per watt and a color rendition that resembles sunlight. The light-emitting device 100 shows a wavelength distribution better match with the luminious sensitivity equivalence of human eyes than most of conventional fluorescent lamps does. Since the light-emitting device of current invention may directly emit visible white light, there is no need to coat fluorescent conversion materials on the chamber wall of the transparent discharge cavity 150 or to use environmentally hazardous mercury material. The light-emitting device 100/100' also shows a minimal aging characteristics over the life span thereof (usually below 5%) in color and brightness of the emitted light.

Thus, planar lighting sources with high energy efficiency may be fabricated using the light-emitting device 100/100' of the invention having high efficient luminous discharge of sulfur molecules. The light-emitting device 100/100' of the invention incorporates a planar energy transmission coil to provide inductive electrical fields for a powerful excitation. Besides, because there is no electrode built within the inner space of the transparent discharge cavity 150 of the light-emitting device 100/100', degradation of electrodes with plasma atmosphere is completely avoided. In addition, since the chamber is fully sealed, no chemical contaminants could be formed therein during the plasma discharging process, thereby ensuring a durable life span and reliability thereof.

The light-emitting device 100/100' of the invention is thus applicable in both applications as concentrated-type and planar-type lighting sources. For applied the light emitting device 100/100' of the invention as a planar lighting source in a backlight module, no diffusion plates or brightness enhancing films would be required as normally necessary while using conventional tubular CCFL as light-emitting source. Therefore, fabrication costs could be decreased, while increasing luminous efficacy and power utilization efficiency of the backlight module. In addition, the light-emitting device 100 of the invention can served as an alternative which directly emits visible light using no wavelength converting fluorescent materials as commonly adopted in conventional cold cathode fluorescent lighting (CCFL) or in flat FED displays. Therefore unfavorable effects such as poor uniformity, aging of phosphors, instability and distortion of color, and erosion of electrodes commonly observed in conventional fluorescent lighting may then be prevented. The energy input to the light-emitting device 100/100' of the invention is directly converted into visible white light with no other middle stages for adjusting wavelength.

The light-emitting device 100/100' of the invention can be further improved by adding peripheral electromagnetic shields (not shown) or other complementary components outside of the discharge cavity to enrich functionality of the light emitting device 100/100'.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A light-emitting device having an excited sulfur medium by inductively-coupled electrons, comprising:

a substrate;

an energy transmission coil disposed over the substrate;

a transparent discharge cavity disposed over the energy transmission coil, having a substantially planar top and bottom surface, wherein the transparent discharge cavity comprises:

a sulfur-containing medium disposed within the transparent discharge cavity; and a buffer gas or a plurality of buffer gasses filling space of the transparent discharge cavity; and a high-frequency oscillating power supply which couples to the energy transmission coil, thereby allowing the energy transmission coil to induce an energy field to the transparent discharge cavity during operation of the light-emitting device.

2. The light-emitting device as claimed in claim 1, further comprising an impedance matching device coupled between the energy transmission coil and the high-frequency oscillating power supply.

3. The light-emitting device as claimed in claim 1, further comprising a light reflection layer disposed between the transparent discharge cavity and the energy transmission coil, wherein the light reflection layer is coated on an outer surface of the transparent discharge cavity.

4. The light-emitting device as claimed in claim 3, wherein the light reflection layer reflects visible light and is transmissive to electromagnetic wave of radio frequency ranging around 5 KHz to 20 MHz.

5. The light-emitting device as claimed in claim 3, wherein the materials of the light reflection layer comprises a simple metal oxide or diachroically compounding of multi-layered metal oxides.

6. The light-emitting device as claimed in claim 3, wherein the light reflection layer comprises a metal film covered by an insulative dielectric layer, and the dielectric layer insulates the metal film in the light reflection layer from the energy transmission coil.

7. The light-emitting device as claimed in claim 1, wherein the sulfur-containing medium comprises a plurality of ingots individually disposed over a bottom surface of the transparent discharge cavity.

8. The light-emitting device as claimed in claim 1, wherein the sulfur-containing medium is a gaseous compound comprising $H_2S$, $SF_4$, $SF_6$, or $SO_2$, and the gaseous sulfur compound is directly filled into the inner space of the transparent discharge cavity by blending with inert buffer gases beforehand

9. The light-emitting device as claimed in claim 1, wherein the high-frequency oscillating power supply supplies the energy transmission coil with AC or DC pulses having a frequency of about 1 KHz-2.45 GHz.

10. The light-emitting device as claimed in claim 1, wherein the transparent discharge cavity is formed of glasses such as quartz, borosilicate or soda lime.

11. The light-emitting device as claimed in claim 1, wherein the buffer gas comprises He, Ne, Ar, Kr, or combinations thereof.

12. The light-emitting device as claimed in claim 11, wherein the buffer gas comprises Ar or Kr.

13. The light-emitting device as claimed in claim 1, wherein the energy transmission coil is formed as a rectangular helix loop or a circular helix loop when viewed from a top view.

14. The light-emitting device as claimed in claim 13, wherein each segment in the energy transmission coil has a pitch of about 0.1 mm to 5 mm therebetween.

15. The light-emitting device as claimed in claim 13, wherein a segment in the energy transmission coil has a line width of about 0.1 mm to 10 mm.

16. The light-emitting device as claimed in claim 1, wherein the energy transmission coil is formed as a U-shaped line, a meander line, a S-shaped line or multiplexed-parallel lines when viewed from a top view.

17. The light-emitting device as claimed in claim 1, wherein the energy transmission coil is encapsulated by the light reflection layer.

18. The light-emitting device as claimed in claim 1, wherein the energy transmission coil is made of conductive metals or transparent conductive oxides.

19. The light-emitting device as claimed in claim 1, wherein the top surface of the energy transmission coil has a distance of about 3-50 mm from the top surface of the transparent discharge cavity.

20. The light-emitting device as claimed in claim 1, wherein the light-emitting device emits visible light.

21. The light-emitting device as claimed in claim 1, wherein the transparent discharge cavity is a sealed cavity.

22. The light-emitting device as claimed in claim 21, wherein the transparent discharge cavity has an inner pressure of about 1-10 atm during operation.

23. The light-emitting device as claimed in claim 1, further comprising peripheral electromagnetic shields disposed outside of the transparent discharge cavity.

* * * * *